United States Patent [19]

Trachte et al.

[11] Patent Number: 4,605,171

[45] Date of Patent: Aug. 12, 1986

[54] FUEL INJECTOR HAVING FUEL-FILLED DAMPING CHAMBER

[75] Inventors: Dietrich Trachte, Leonberg; Helmut Giess, Aspach, both of Fed. Rep. of Germany

[73] Assignee: Robert Bosch GmbH, Stuttgart, Fed. Rep. of Germany

[21] Appl. No.: 600,043

[22] Filed: Apr. 13, 1984

[30] Foreign Application Priority Data

Aug. 13, 1983 [DE] Fed. Rep. of Germany ..... 3329380

[51] Int. Cl.[4] ..... F02M 61/08; F02M 61/16

[52] U.S. Cl. ..... 239/453; 239/533.3; 239/533.12

[58] Field of Search ..... 239/533.2–533.12, 239/452, 453, 585; 267/8 R; 188/297, 316, 322.22

[56] References Cited

U.S. PATENT DOCUMENTS 4,531,676 7/1985 Seifert ..... 239/453

FOREIGN PATENT DOCUMENTS 2093912 9/1982 United Kingdom ..... 239/533.9

2097077 12/1982 United Kingdom ..... 239/533.2

*Primary Examiner*—Andres Kashnikow

*Assistant Examiner*—Kevin Patrick Weldon

*Attorney, Agent, or Firm*—Edwin E. Greigg

[57] ABSTRACT

A fuel injection nozzle for internal combustion engines, having an outwardly opening valve needle, which is connected with a piston upon which a damping cap is placed, which is supported on a shoulder integral with the housing. In the damping cap, a damping chamber is formed, which communicates via a throttle conduit with the flow path of the fuel. The diameter of the piston is smaller than the cross section enclosed by the valve seat, as a result of which an annular shoulder is attained, on which the unthrottled fuel pressure acts upon the valve needle in the opening direction. This disposition has the advantage that at lower rpm and smaller fuel quantities, the valve needle can be effectively braked even up to relatively long needle strokes, without the injection duration becoming overly long at higher rpm.

6 Claims, 1 Drawing Figure

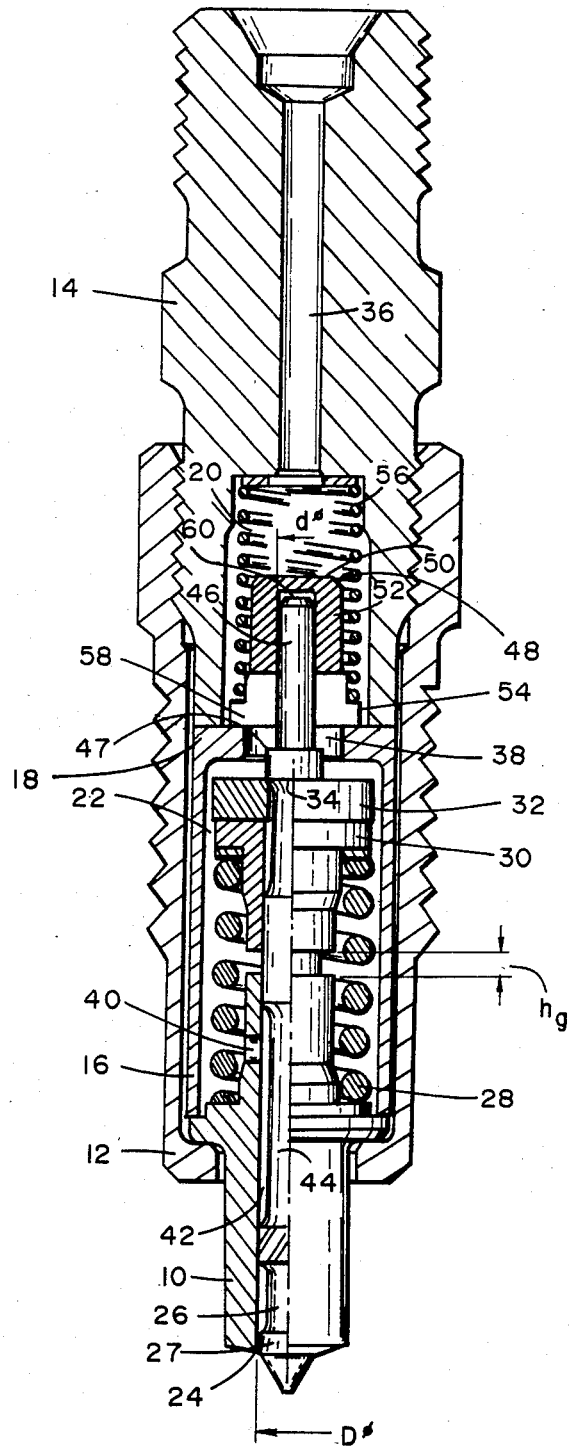
14
36
20
56
60
d
50
46
52
48
58
54
47
38
18
22
34
32
30
40
$h_g$
16
28
12
44
42
10
26
27
24
D

FUEL INJECTOR HAVING FUEL-FILLED DAMPING CHAMBER

BACKGROUND OF THE INVENTION

The invention is based on a fuel injection no nozzle as described and claimed hereinafter. In injection nozzles of this type, the opening movement of the valve needle is damped or retarded over at least a portion of the stroke thereof by providing that the fuel can flow into the damping chamber, which is increasing in size at that time, only via the throttle conduit. In a known embodiment, the damping chamber and the piston connected with the valve needle have the same diameter as the valve seat, so that only the fuel pressure exerted on the end face of the piston is available in the damping chamber for displacing the valve needle. In this arrangement, the damping or retardation of the valve needle has a greater effect, the greater the fuel pressure is in the spring chamber. The valve needle may therefore, under some circumstances, attain its fully open position too early at relatively low rpm or too late at relatively high rpm.

OBJECT AND SUMMARY OF THE INVENTION

The apparatus according to the invention has the advantage over the prior art that an annular shoulder is formed on the valve needle or on the piston, and this shoulder is engaged by the unthrottled fuel pressure in the spring chamber, while the fuel pressure in the damping chamber acts only as a supplementary partial force upon the piston and valve needle. It is thereby attained that even in the upper rpm ranges of the engine, a sufficient force is already available at the onset of injection for accelerating the valve needle, and this force is exerted upon the valve needle in an unretarded manner. In the lower rpm and injection quantity range, the valve needle may also be effectively damped or retarded up to relatively long needle strokes without thereby causing the injection duration to be excessively long at higher rpm.

It is particularly advantageous if the closing spring, the mass of the valve needle including the piston, the cross sections of the piston and throttle conduit, and the cross section surrounded by the valve seat are all adapted to one another such that above a predetermined threshold value for the fuel pressure in the spring chamber, the fuel pressure in the damping chamber drops down to the vapor pressure, at the prevailing operating temperature, of the fuel being used.

It is thereby attained that beyond a predetermined pressure in the spring chamber, the fuel pressure exerted in the damping chamber upon the valve needle in the opening direction is not further reduced, so that at least from that operating point on the damping effect is relatively diminished again. The injection pressure rises more quickly at higher rpm, as a result of which an earlier opening is attained and the injection duration is shortened. Over the entire rpm/load range, the injection course thus rises slowly at the beginning, this being determined by the speed of the rise in pressure between the opening pressure and the critical pressure and by the adaptation of the above mentioned parameters to one another. With the provisions according to the invention, it is also possible to influence the injection characteristic.

A simple and functionally reliable construction is attained by the damping chamber being arranged to include a cap which is placed upon the piston, with the structure being designed so that the cap comes to rest on a blocking shoulder integral with the housing no later than when a first pre-stroke of the valve needle has been executed. A further simplification is the result of the provision that the throttle conduit leading from the spring chamber into the damping chamber is embodied by the radial play between the piston and the bore wall.

The pressure shoulder located in the spring chamber on the valve needle or the piston is realized in a simple manner if the cross section of the damping chamber in the cap is smaller than the cross section surrounded by the valve seat.

The invention will be better understood and further objects and advantages thereof will become more apparent from the ensuing detailed description of a preferred embodiment taken in conjunction with the drawing.

BRIEF DESCRIPTION OF THE DRAWING

The sole drawing FIGURE is a longitudinal section taken through the exemplary embodiment.

DESCRIPTION OF THE PREFERRED EMBODIMENT

The injection nozzle has a nozzle body 10, which is fastened by means of a sleeve nut 12 to a nozzle holder 14. A sheath 16 is disposed between the nozzle body 10 and the nozzle holder 14, having an inwardly pointing collar 18, which divides a chamber 20 from a chamber 22 of larger diameter in the interior of the injection nozzle. A valve seat 24 having the diameter D is formed in the nozzle body 10 and a valve needle 26 is displaceably supported in the nozzle body 10, its sealing cone 27 being pressed by a closing spring 28 against the valve seat 24. The closing spring 28 is supported on the nozzle holder 10 and via a flange part 30 engages a support disc 32, which in turn is supported on a shoulder 34 of the valve needle 26.

An inflow bore 36 is formed in the nozzle holder 14, discharging into the chamber 20, which communicates via an opening 38 surrounding the collar 18 with the chamber 22. From this chamber 22, a bore 40 leads in the nozzle body 10 into an annular chamber 42, which is formed between the central bore wall of the nozzle body 10 and the jacket circumference of a section 44 of smaller diameter of the valve needle 26 and extends to a point just in front of the valve seat 24. Between the flange part 30 and the nozzle body 10, there is in the closing position, shown, a distance $h_g$, which corresponds to the total stroke of the valve needle 26. The valve needle 26 is displaced outward in the opening direction by the fuel pressure, counter to the closing spring 28, until the flange part 30 strikes the nozzle body 10. Upon the closure of the valve, the closing spring 28 returns the valve needle 26 inward into the closing position shown.

A piston-like extension 46 is continuous with the shoulder 34 of the valve needle 26, passing through the opening 38 and protruding into the chamber 20. The diameter d of the piston-like extension 46 is smaller than the valve seat diameter D and the guide diameter, corresponding thereto [i.e., to D], of the valve needle 26. As a result, an annular shoulder 47 is formed on the valve needle 26 at the transition to the extension 46, and this annular shoulder 47 is engaged by the fuel pressure in the opening direction. A cap 48 is placed upon the extension 46, having a bottom 50, a jacket part 52 and a flanged rim 54. The cap 48 is engaged by a restoring spring 56, which surrounds the jacket part 52 and presses the flanged rim 54 against the collar 18 of the sheath 16.

In the flanged rim 54 and a region of the jacket face 52 of the cap 48 adjacent thereto, transverse slits 58 are provided, through which, when the valve needle 26 is opened, the fuel can pass out of the chamber 20 into the chamber 22. In the closing position of the valve needle 26 shown, a damping chamber 60 is formed in the cap 48 between the end face of the extension 46 and the bottom 50. Via the radial play between the extension 46 and the cap 48, the damping chamber 60 communicates in a throttled manner with the flow path of the fuel.

The injection nozzle functions as follows:

Before the beginning of an injection event, the same pressure prevails in the damping chamber 60 as in the chambers 20 and 22, because of the equalization of pressure via the radial play of the extension 46. This pressure acts upon the valve needle 26 upon an area determined by the diameter of the valve seat 24. Once the pressure has attained a predetermined value, the valve needle 26 is raised from the valve seat 24 and fuel is ejected. Upon the opening movement of the valve needle 26, a pressure difference is created between the damping chamber 60 and the chamber 20, because the cap 48 cannot follow the movement of the valve needle 26, and the fuel can pass only in a throttled manner through the radial play of the extension 46 into the damping chamber 60. The result is a diminution of the force exerted by the fuel upon the valve needle 26 in the opening direction, and this effect is the more pronounced, the higher the fuel pressure or the faster the speed of the increase in fuel pressure in the chambers 20 and 22. The valve needle 26 is therefore displaced in the opening direction in a damped or retarded manner.

The closing spring 28, the mass of the valve needle 26 together with the extension 46, the cross sections of the extension 46 and its radial play, as well as the cross section of the bore in the nozzle body 10 surrounded by the valve seat 24 are all adapted to one another such that the pressure in the damping chamber 60 drops down to the vapor pressure of the fuel at the prevailing operating temperature, if the fuel pressure in the chambers 20 and 22 exceeds a predetermined critical value. Accordingly, any further reduction in the pressure in the damping chamber 60 is now impossible; that is, the pressure force exerted on the end face of the extension 46 cannot drop any further. This is precisely the case if the pressure force upon the annular surface area determined by D—d suffices to keep the counteracting forces (spring pressure, counterpressure from the engine compartment) in balance. If the critical pressure required therefor is exceeded, the excess pressure force becomes effective for freely accelerating the masses (needle, etc.) to be moved, because vapor pressure continues to prevail in the damping chamber 60 independently of any further displacement of the needle (for instance, of the extension 46).

At fuel pressures below the critical value, the valve needle 26 is capable of opening only approximately as fast as fuel can flow into the damping chamber 60 to refill it. The critical value must accordingly be designed such that it is not exceeded in operating ranges for which a long injection duration is required, such as idling. At fuel pressures above the critical value, forces for accelerating the valve needle 26 are generated which move the valve needle rapidly into its fully opened position. At lower rpm and smaller fuel quantities, the valve needle 26 can also be effectively braked over relatively long needle strokes, without the injection duration becoming overly long at higher rpm.

The foregoing relates to a preferred exemplary embodiment of the invention, it being understood that other variants and embodiments thereof are possible within the spirit and scope of the invention, the latter being defined by the appended claims.

What is claimed and desired to be secured by letters patent of the United States is:

1. A fuel injection nozzle for internal combustion engines comprising a nozzle body, a valve seat integral with said nozzle body, and a valve needle displaceably supported in said nozzle body at an injection opening, said valve seat being monitored by said valve needle injection opening in the fuel flow direction, a closing spring in a first chamber for loading said valve needle, a fuel inflow line arranged to discharge into said first chamber, a second chamber upstream from said first chamber, a dividing wall means separating said second chamber from said first chamber and including a blocking shoulder in said second chamber, said valve needle including an end extension piston that extends with radial clearance through said dividing wall means into said second chamber, a cap including a blind bore bottom positioned on said end extension piston and arranged in said second chamber, a damping chamber formed by said cap, said blind bore bottom of said cap and an end face of said end extension piston, a throttle conduit in said cap adapted to lead away from and to said second chamber into said damping chamber, a restoring spring in said second chamber, acting on the cap for shifting the cap against said blocking shoulder on said dividing wall means, said cap arranged to rest on said blocking shoulder no later than after a first prestroke of the valve needle, and said end extension piston of the valve needle includes a cross section which is smaller than a cross section of said piston enclosed by said valve seat.

2. An injection nozzle as defined by claim 1, further wherein said closing spring, the mass of said valve needle together with said piston, as well as the cross sections of said end extension piston and the throttle conduit, and the cross section surrounded by the valve seat are all adapted to one another such that above a predetermined threshold value of the fuel pressure in said second chamber, the fuel pressure in the damping chamber drops down to the vapor pressure of the fuel at the prevailing operating temperature.

3. An injection nozzle as defined by claim 2, further wherein said cap is arranged to periodically rest on said blocking shoulder integral with a sheath and includes a flanged end upon which said restoring spring seats.

4. An injection nozzle as defined by claim 1, further wherein said cap is arranged to periodically rest on said blocking shoulder integral with a sheath and includes a flanged end upon which said restoring spring seats.

5. An injection nozzle as defined by claim 1, further wherein said throttle conduit leading from and to the second chamber into said damping chamber is formed by a radial play between said end extension piston and a bore wall provided in said cap.

6. An injection nozzle as defined by claim 1, further wherein said cross section of said damping chamber in the cap is smaller than said cross section of said valve needle surrounded by said valve seat.

* * * * *